US005934377A

United States Patent [19]

Savage

[11] Patent Number: 5,934,377

[45] Date of Patent: Aug. 10, 1999

[54] METHOD FOR ISOLATING HYDROCARBON-CONTAINING FORMATIONS INTERSECTED BY A WELL DRILLED FOR THE PURPOSE OF PRODUCING HYDROCARBONS THERETHROUGH

[75] Inventor: Ronald E. Savage, Marlow, Okla.

[73] Assignee: Halliburton Energy Services, Inc., Duncan, Okla.

[21] Appl. No.: 08/868,317

[22] Filed: Jun. 3, 1997

[51] Int. Cl.[6] ..... E21B 33/13; E21B 43/26

[52] U.S. Cl. ..... 166/281; 166/284; 166/297; 166/308

[58] Field of Search ..... 166/281, 284, 166/285, 297, 308, 387, 55.1

[56] References Cited

U.S. PATENT DOCUMENTS

| | | | |
|---|---|---|---|
| 2,933,136 | 4/1960 | Ayer et al. | 166/284 |
| 2,986,214 | 5/1961 | Wiseman, Jr. et al. | 166/297 X |
| 3,028,914 | 4/1962 | Flickinger | 166/284 |
| 3,111,988 | 11/1963 | Davis et al. | 166/308 X |
| 4,410,387 | 10/1983 | Halkerston et al. | 156/245 |
| 5,025,861 | 6/1991 | Huber et al. | 166/297 |
| 5,131,472 | 7/1992 | Dees et al. | 166/284 X |
| 5,301,755 | 4/1994 | George et al. | 166/297 |
| 5,353,875 | 10/1994 | Schultz et al. | 166/297 |
| 5,398,760 | 3/1995 | George et al. | 166/297 |
| 5,669,448 | 9/1997 | Minthorn et al. | 166/308 |
| 5,704,426 | 1/1998 | Rytlewski et al. | 166/297 |

*Primary Examiner*—George Suchfield
*Attorney, Agent, or Firm*—Robert A. Kent; Stephen R. Christian; Anthony L Rahhal

[57] ABSTRACT

A method for isolating subterranean formations or zones intersected by a single wellbore is provided. The method comprises perforating a zone intersected by the wellbore and pumping a sealing means into the wellbore to seal against the side of the casing above and below the perforations to prevent communication from the zone into the wellbore after the casing has been perforated. The method further comprises fracturing the zone through the perforations prior to sealing and thus isolating the zone. Other zones thereabove are likewise perforated, fractured, sealed and thus isolated by pumping sealing means into the wellbore to seal the casing adjacent the perforations to prevent communication from the affected zones into the wellbore.

29 Claims, 5 Drawing Sheets

METHOD FOR ISOLATING HYDROCARBON-CONTAINING FORMATIONS INTERSECTED BY A WELL DRILLED FOR THE PURPOSE OF PRODUCING HYDROCARBONS THERETHROUGH

BACKGROUND OF THE INVENTION

The present invention relates generally to methods for isolating hydrocarbon-containing zones, or production zones intersected by a wellbore. More specifically, the invention relates to a method for sealing the wellbore adjacent zones that have been perforated so that the casing in the wellbore may be perforated and sealed adjacent other zones thereabove.

One operation commonly performed in the completion of an oil or gas well is the perforation of the steel casing of the well to communicate the wellbore with subterranean formations, also referred to herein as production zones, or simply a zone, intersected by the well. Formation fluids are thus allowed to be produced from the formation through the perforations into and up through the wellbore.

Numerous techniques and apparatus are used for conveying perforating guns to perforate the casing, along with associated apparatus into the well including assembling the same on a tubing string thus providing what is commonly referred to as a tubing-conveyed perforating (TCP) system. Perforating guns may also be lowered into a wellbore utilizing coiled tubing and wirelines. Likewise, numerous techniques for actuating perforating guns have been used including (1) electrical actuation; (2) actuation with drop bar mechanisms; and (3) pressure-actuation mechanisms. Perforating guns that are actuated by pressure may be actuated by pressure applied in the tubing or in the casing, depending on the type of perforating gun.

Further, a subterranean formation that has been perforated to provide communication with the wellbore very often must be stimulated or otherwise treated to stimulate the production of fluids. Hydraulic fracturing is a widely used technique for stimulating the production of fluids, such as oil and gas from subterranean formations. Fracturing is commonly performed by contacting a subterranean formation with a viscous fracturing fluid that contains a propping agent suspended therein. The fracturing fluid is communicated with the formation through the perforations. Sufficient hydraulic pressure is applied to the subterranean formation by way of the fracturing fluid and surface pumping equipment to cause one or more fractures to be created in the subterranean formation. After initial fracturing occurs, the fracturing fluid is pumped at a sufficient rate and pressure to cause the fracturing fluid to flow into the created fractures and extend them in the formation. The propping agent suspended in the fracturing fluid is carried into the fracture so that when the flow rate of the fracturing fluid is reduced, the propping agent is deposited into the fractures and the fractures are prevented from closing thereby. Such fracturing increases the permeability of the formation.

Very often a wellbore will intersect more than one subterranean hydrocarbon-containing formation whereby it is desired to perforate the casing adjacent more than one formation and to fracture the formations so that formation fluids, which may also be referred to as production fluids, may be produced up the wellbore from more than one subterranean formation. To perforate the casing adjacent multiple zones and to fracture multiple zones intersected by a single wellbore, zones that have already been communicated with the wellbore by perforating must be isolated while the wellbore is being perforated adjacent other zones. In other words, once the casing has been perforated adjacent a subterranean formation and that formation has been hydraulically fractured, the formation must be isolated prior to perforation of the casing adjacent a formation thereabove and the fracturing of that formation. Methods of perforating and stimulating formations are described in U.S. patent application Ser. No. 08/569,822, filed on Dec. 8, 1995, now U.S. Pat. No. 5,669,448, entitled OVERBALANCE PERFORATING AND STIMULATION METHOD FOR WELLS, assigned to the assignee of the instant application, the details of which are incorporated herein by reference. Techniques employed that allow the perforation and fracturing of multiple zones in a wellbore include the use of retrievable and drillable packers to seal a wellbore so that more than one zone can be perforated and stimulated.

While such presently used techniques are useful, other techniques which are easier to use, less costly and less time-consuming are desired.

SUMMARY OF THE INVENTION

The present invention provides improved methods for isolating subterranean formations, also referred to herein as production zones, or zones, intersected by a single wellbore. The isolation of zones is achieved by pumping a sealing means into the wellbore to seal the casing adjacent perforations in the casing, thereby preventing communication between the zone and the wellbore through the perforations. Thus, the method comprises lowering a perforating gun into the wellbore and perforating the wellbore adjacent a production zone and pumping a sealing means into the wellbore to seal the wellbore adjacent the perforations, thereby isolating the zone. The sealing means will be of sufficient overall length in the wellbore to seal the casing above and below the perforations so that communication between the zone and the wellbore through the perforations is prevented.

Once a first zone, which will preferably be a lowermost desired zone intersected by the wellbore, has been sealed, and thus isolated, hydraulic pressure is maintained and a perforating gun can be again lowered into the well so that an additional zone located above the previously isolated zone can be perforated. Thus, the method may further include perforating the casing adjacent a second zone located in said wellbore above the first zone. A second sealing means can then be pumped into the wellbore and displaced downward so that it seals the wellbore adjacent the second perforated zone to prevent communication therefrom into the wellbore, thereby isolating the second perforated zone. The method may thus comprise perforating and sealing a desired number of zones in sequence from a lowermost desired zone to an uppermost desired zone until the desired number of zones have been perforated and sealed, thereby isolating each zone. The uppermost desired zone may be perforated and sealed or may simply be, perforated prior to allowing fluid production therefrom.

In addition, the method may comprise fracturing selected zones after perforating and prior to sealing the zone. Such fracturing is a technique well known in the art. With the present invention, the zones are fractured by any such known technique, such as displacing a proppant containing fracturing fluid down the wellbore into the zone through the perforations made in the casing. The sealing means will be displaced down the wellbore behind the fracturing fluid so that the proper amount of fracturing fluid will be delivered into the zone being fractured prior to the casing being sealed adjacent the zone. Once a desired number of zones have been perforated, fractured and sealed, the sealing means may be removed from the wellbore and fluid from the zones can be produced upward to the surface through the wellbore. The sealing means may be removed by allowing pressure from the zones to backflow the sealing means out of the wellbore. The sealing means may also be removed by drilling through the sealing means to communicate the zones with the wellbore. The sealing means may include but is not limited to a plurality of elastically deformable spherical balls having an undeformed cross-sectional diameter greater than the inside diameter of the wellbore. Thus, the balls, when they are pumped into the wellbore, will deform and will seal against the casing. The balls are preferably made from but are not limited to nitrile rubber.

Numerous objects, features and advantages of the present invention will be readily apparent to those skilled in the art upon a reading of the following disclosure when taken in conjunction with the accompanying drawings.

DETAILED DESCRIPTION OF THE PREFERRED EMBODIMENTS

Figure 1:
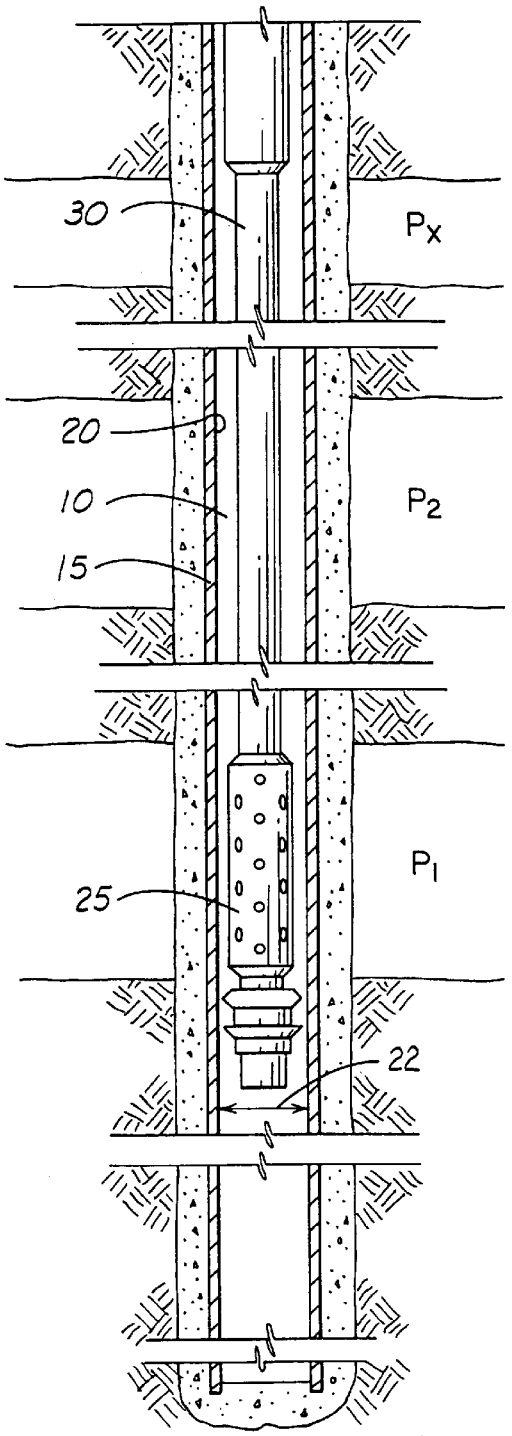
FIG. 1 schematically shows a perforating gun lowered into a wellbore and positioned adjacent a subterranean formation to be perforated.
Figure 2:
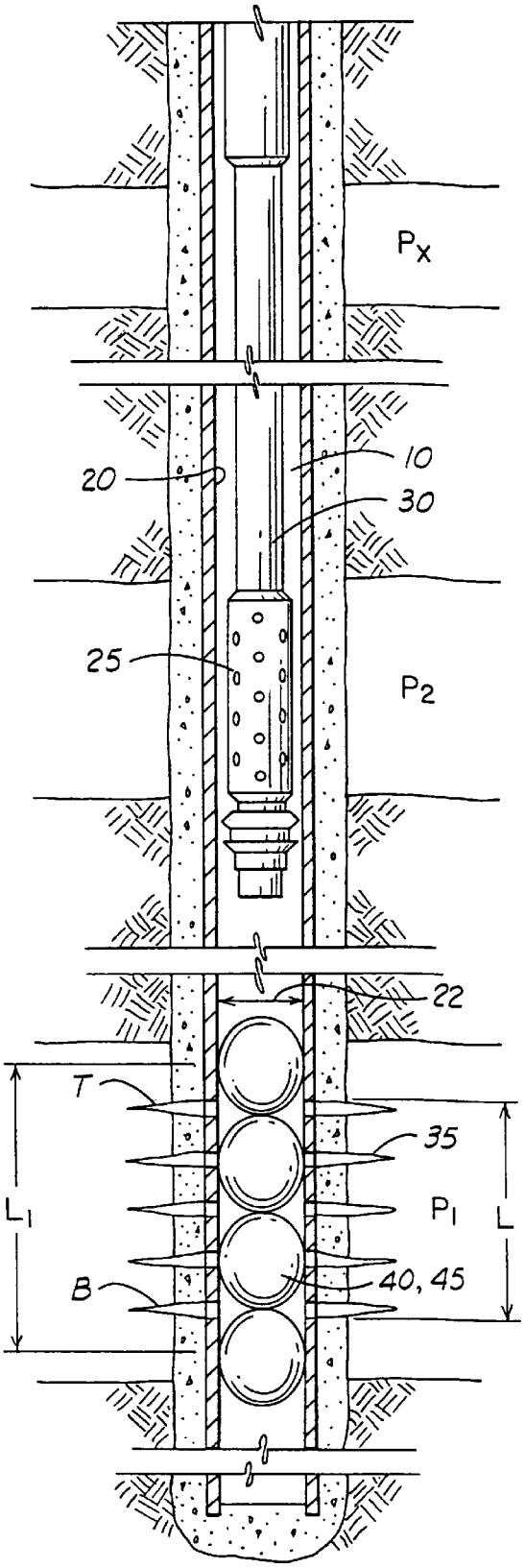
FIG. 2 schematically shows the wellbore of FIG. 1 after a subterranean formation has been perforated and sealed to isolate the formation according to the present invention, and schematically shows a perforating gun positioned in the wellbore adjacent a subterranean formation above the isolated formation.
Figure 3:
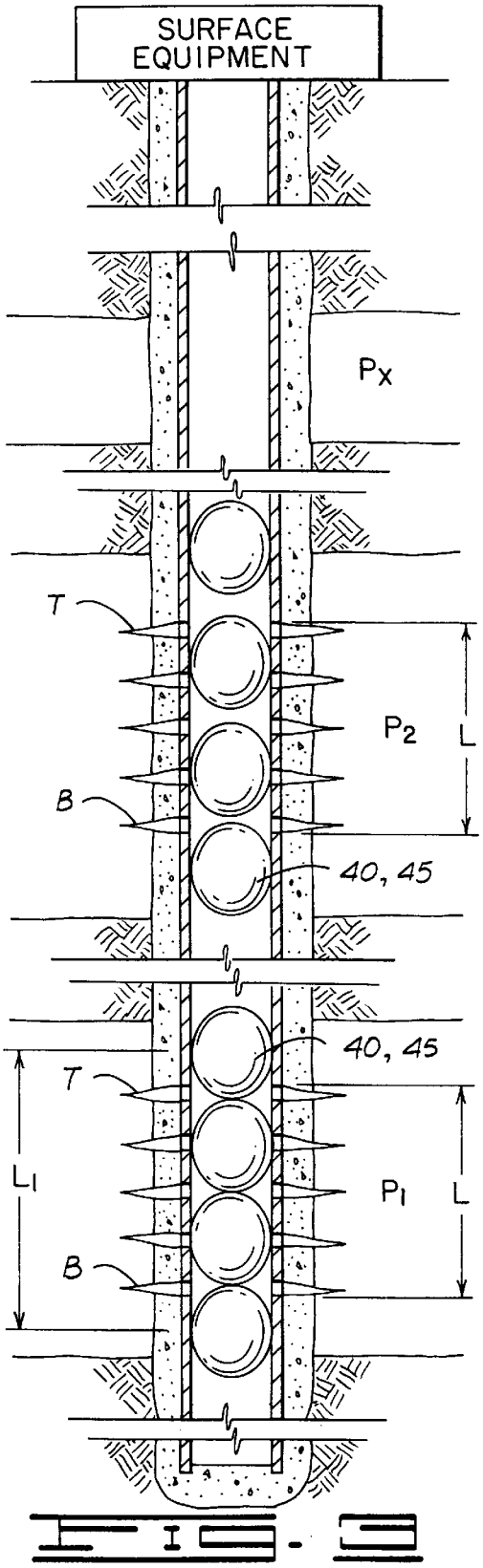
FIG. 3 schematically shows a wellbore intersecting a plurality of subterranean formations wherein the wellbore has been perforated and sealed adjacent a lower formation and wherein the formation thereabove has been perforated and partially sealed.

Referring now to the figures, a wellbore 10 is schematically represented in FIG. 1 intersecting a plurality of subterranean formations or production zones $P_1$ through $P_x$ wherein $P_x$ represents the uppermost desired zone to be perforated. Any number of production zones P may be isolated utilizing the method of the present invention from 1 to X, wherein X may be any number and is the uppermost and the last zone from which production is desired. $P_x$ may thus represent a second zone, a third zone or any numbered zone thereabove, which may be isolated using the method of the present invention. The subscript beside each letter P is thus used for reference purposes where $P_1$ is the lowermost desired zone to be isolated and the zones thereabove are referred to as $P_2$ to $P_x$. A casing 15 has been installed in the wellbore and defines a casing bore 20, which has a diameter 22. FIGS. 1 and 2 schematically show a perforating gun 25 lowered into wellbore 10 on a tubing string 30. FIG. 1 shows perforating gun 25 positioned adjacent a lowermost production zone $P_1$. FIG. 2 schematically shows perforating gun 25 adjacent a zone $P_2$ positioned above zone $P_1$, which has been isolated according to the present invention as will be described hereinbelow. FIG. 3 schematically depicts the wellbore after the zone $P_1$ has been perforated, and sealed, and thereby isolated according to the present invention, and shows an additional zone thereabove in the process of being sealed.

Referring to FIG. 1, the method may include lowering a perforating gun into the wellbore until the perforating gun is adjacent a desired zone P, which may be the lowermost desired zone $P_1$ intersected by the wellbore, and perforating the zone $P_1$ to make perforations 35 in the casing, thus communicating the zone $P_1$ with the well 10. The perforating gun used to make the perforations may be lowered on a tubing, a wireline or coiled tubing or by any means known in the art. The gun may be actuated electrically, mechanically by a drop bar, or by tubing or casing pressure, or any other means known in the art. The perforating gun may be of a type that drops into the well after it is actuated. Preferably, the perforating gun will be retrieved after the casing has been perforated.

Figure 3A:
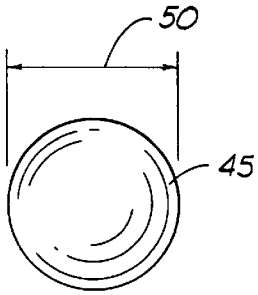
FIG. 3A schematically shows an elastically deformable ball having an undeformed cross-sectional diameter.

As depicted by FIGS. 1–3, after the lowermost selected, or desired zone $P_1$ has been perforated, the method comprises pumping a sealing means 40 into the well and displacing the sealing means downward until it is adjacent the perforations. Sealing means 40 preferably comprises a plurality of elastically deformable balls 45 having an undeformed cross-sectional diameter 50, as shown in FIG. 3A. Diameter 50 of an undeformed ball is greater than diameter 22 of casing bore 20 so that balls 45 will deform into an oval shape when pumped into the casing bore and will seal against the casing bore 20. For instance, by way of example and not by limitation, in casing having a 4½-inch inner diameter, a ball having an outer diameter of 5.5 to 6 inches might be used. Balls 45 are preferably made from nitrile rubber, but can be made from any elastically deformable substance that will maintain a seal against the casing when it is deformed and displaced down the casing. The balls may be pumped into the casing from the surface utilizing surface equipment known in the art.

Prior to sealing the perforated zone, however, it may be desirable to hydraulically fracture the zone. Hydraulic fracturing is a technique known in the art whereby a proppant containing fracturing fluid is displaced under pressure into the wellbore and into the production zone to increase the permeability of the zone. Sufficient hydraulic pressure is applied to the production zone by way of the fracturing fluid and surface pumping equipment. Thus, the method of the present invention may include fracturing the zone by displacing a proppant containing fluid down the wellbore and into the zone $P_1$, or other perforated zone, through the perforations 35 prior to pumping the sealing means into the wellbore.

One method of delivering the sealing means to the casing bore is through a surface manifold. The balls may be injected from the surface manifold into the flow line utilized to deliver the fracturing fluid to the wellbore. Sealing balls 45 may thus be injected into the wellbore behind a design volume of fracturing fluid, which is simply the amount of fracturing fluid that will be pumped into the subterranean formation, and will be a predetermined volume. Balls 45 may also be introduced into the wellbore, behind the fracturing fluid, from a plug container. Hydraulic pressure is maintained with surface pumping equipment which will push the balls 45 downward, and consequently will force the fracturing fluid into the zone $P_1$, or other desired zone P, through the perforations in the casing. In other words, after sealing balls 45 are placed or injected in the wellbore, the hydraulic pressure is maintained and the fracturing fluid ahead of the balls will be forced into the zone to be isolated. Once the lowermost ball 45 engages casing bore 20 below the bottom perforation, which is indicated by the letter B, hydraulic lock will prevent further downward flow of the ball. A sufficient number of balls must be used to seal the casing below the bottom perforation B and above the top perforation, which is designated by the letter T. Thus, if the perforations span a length L in the wellbore, then a sufficient number of balls 45 must be utilized so that the distance between the point above the perforations where the uppermost ball in the sealing means engages the casing, and the point below the perforations where the lowermost ball is a sealing means engages the casing is at least a distance $L_1$ which is greater than L, so that the casing is sealed both above and below the perforations, thus isolating the zone. Because the diameter of the balls is larger than the diameter of the casing, and because the balls are elastically deformable, the balls will push against the casing bore, and will stay in sealing engagement therewith, thus isolating the zone.

FIG. 2 schematically shows a perforating gun lowered into the wellbore and positioned adjacent a zone $P_1$, in this case zone $P_2$. Once the first zone in a wellbore has been isolated, pressure must be maintained while the perforating gun is lowered into the well to perforate the casing adjacent a zone $P_2$ or other additional zones thereabove. Thus, the perforating gun can be lowered on a tubing string using a lubricator, on a wireline, or by any other means known in the art. The method can thus comprise actuating the perforating gun to perforate the casing adjacent the zone $P_2$, and fracturing and sealing the zone P, in the manner described herein, to isolate the zone $P_2$. FIG. 3 shows a zone $P_2$ wherein the balls are being pumped downward in the wellbore adjacent the zone $P_2$. The lower ball adjacent the zone $P_2$ will stop its downward flow once it engages the casing bore below the bottom perforation B adjacent the second zone, due to hydraulic lock.

The sealing means adjacent zone $P_2$ must comprise enough balls so that, as described with reference to zone $P_1$, the distance $L_1$, which is the distance between the point above the casing perforations and the point below the perforating where the sealing means engages the casing, is greater than the distance L, which is the distance between the top and bottom perforations in the casing. Thus, as is obvious from the foregoing, each zone to be isolated will have a corresponding sealing means which may be referred to as a first sealing means for zone $P_1$, a second sealing means for zone $P_2$, and so on through sealing means number X for zone $P_x$. The sealing means which corresponds to a particular zone may have a different length $L_1$, and thus may require different numbers of sealing balls that the sealing means for corresponding to other zones. In other words, distance L may vary for each zone. Thus, L for zone $P_1$ may be larger or smaller than L for the second zone $P_2$, the third zone $P_3$, and so on through P. The distance $L_1$ for zone $P_1$ may therefore be larger or smaller than $L_1$ for the zone $P_2$, $P_3$ and so on through $P_x$. Thus, the number of balls 45 required to seal the casing and isolate each zone may vary from zone to zone.

Any number of zones intersected by a wellbore can thus be perforated, fractured, and sealed in sequence upwardly from a lowermost desired production zone $P_1$ to an uppermost desired production zone, $P_x$ wherein X can be any number equal to or greater than 2, thereby isolating zones that have been previously communicated with the wellbore. The uppermost production zone can be left unsealed if desired. Once the desired number of zones has been isolated, the sealing means may be removed and the isolated zones can be allowed to communicate with the wellbore. Sealing means 40 may be removed by allowing the hydraulic pressure in the zones to backflow the sealing means up and out of the wellbore where they can be caught by a plug container or other means at the surface. If the pressure in the formation is insufficient to backflow the sealing means out of the wellbore, then the method may further comprise drilling through the sealing means to provide communication between the zones adjacent the perforations and the wellbore.

Figure 4:
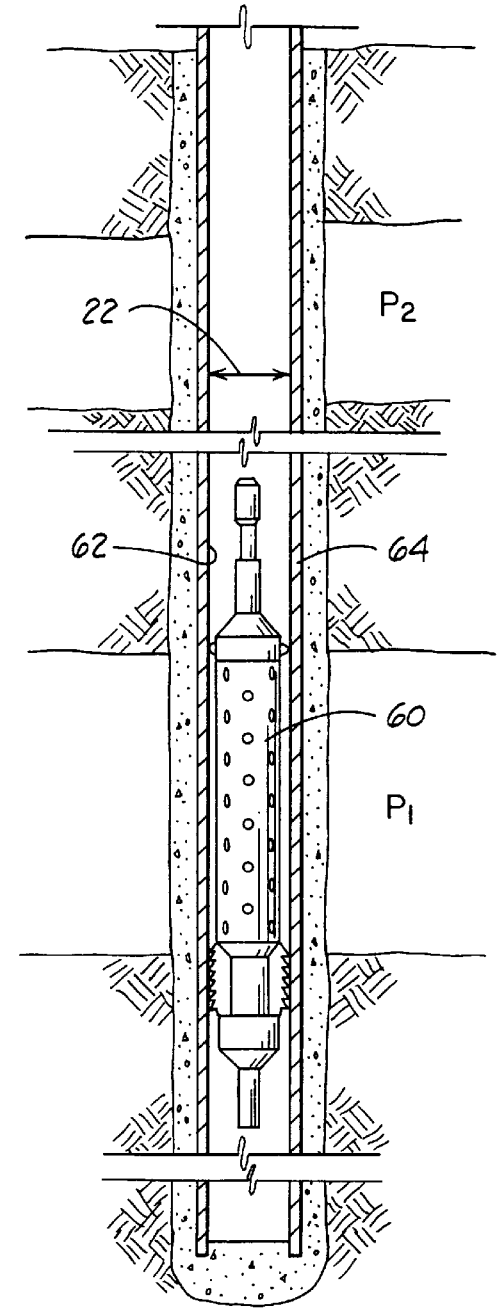
FIG. 4 schematically shows a wellbore wherein a perforating gun is hung in place in the casing adjacent a subterranean formation.
Figure 5:
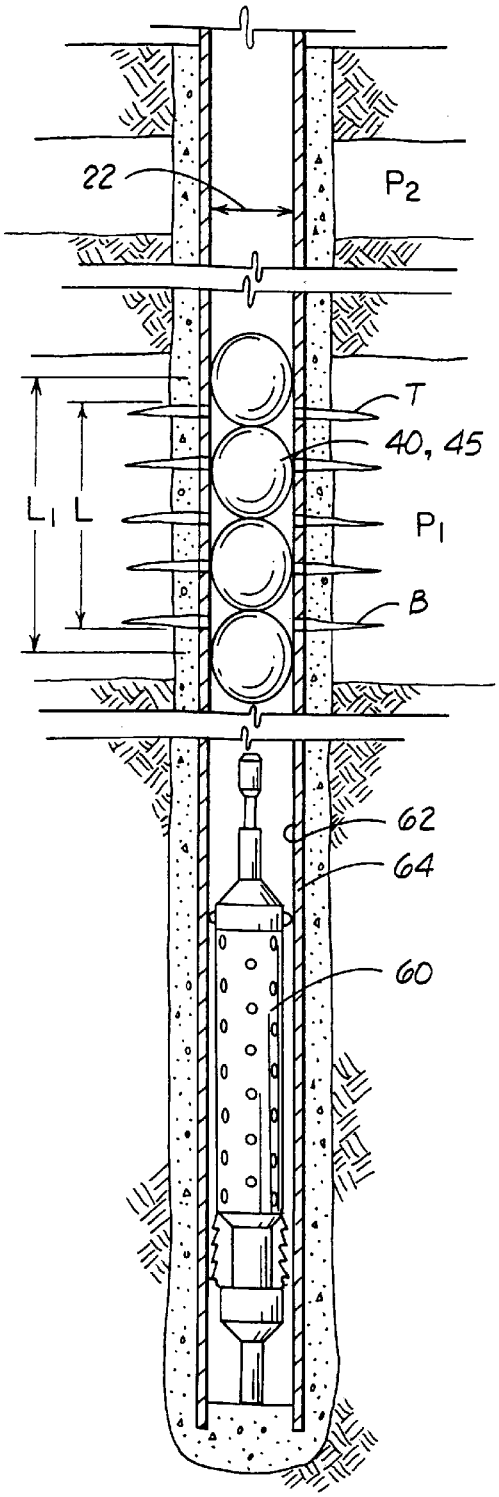
FIG. 5 schematically shows the wellbore of FIG. 4 after it has been perforated and sealed at a lowermost desired formation and the perforating gun has dropped to the bottom of the wellbore.
Figure 6:
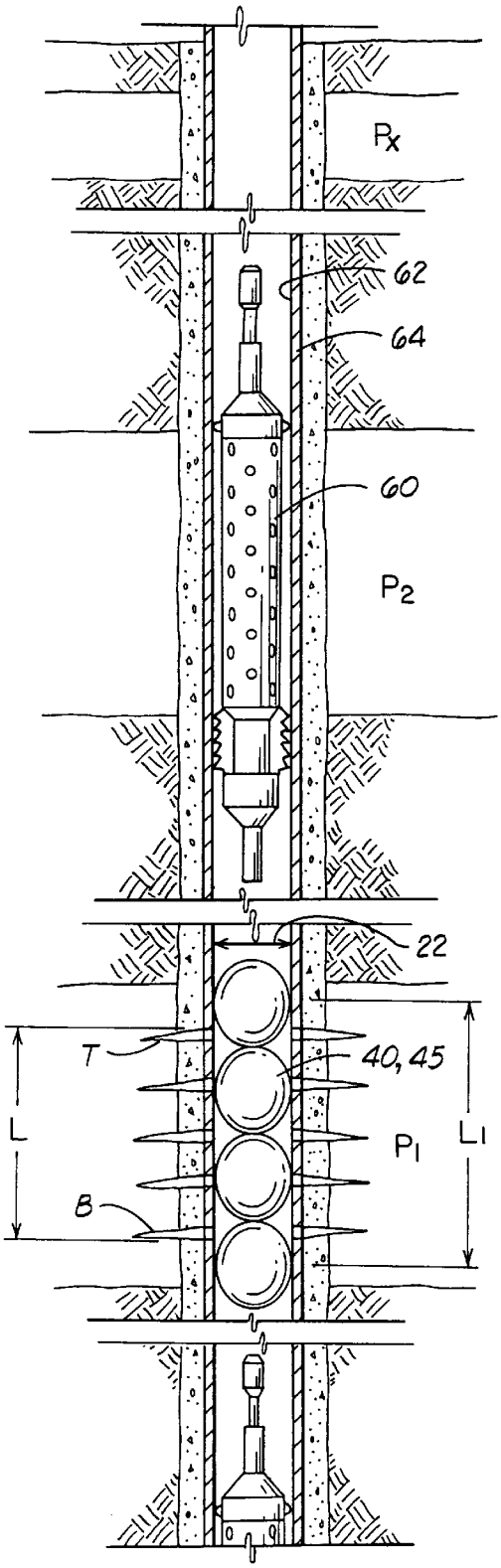
FIG. 6 schematically shows an arrangement similar to FIG. 4 wherein the perforating gun is hung in the wellbore adjacent a formation to be sealed above a formation that has been perforated and isolated according to the present invention.
Figure 7:
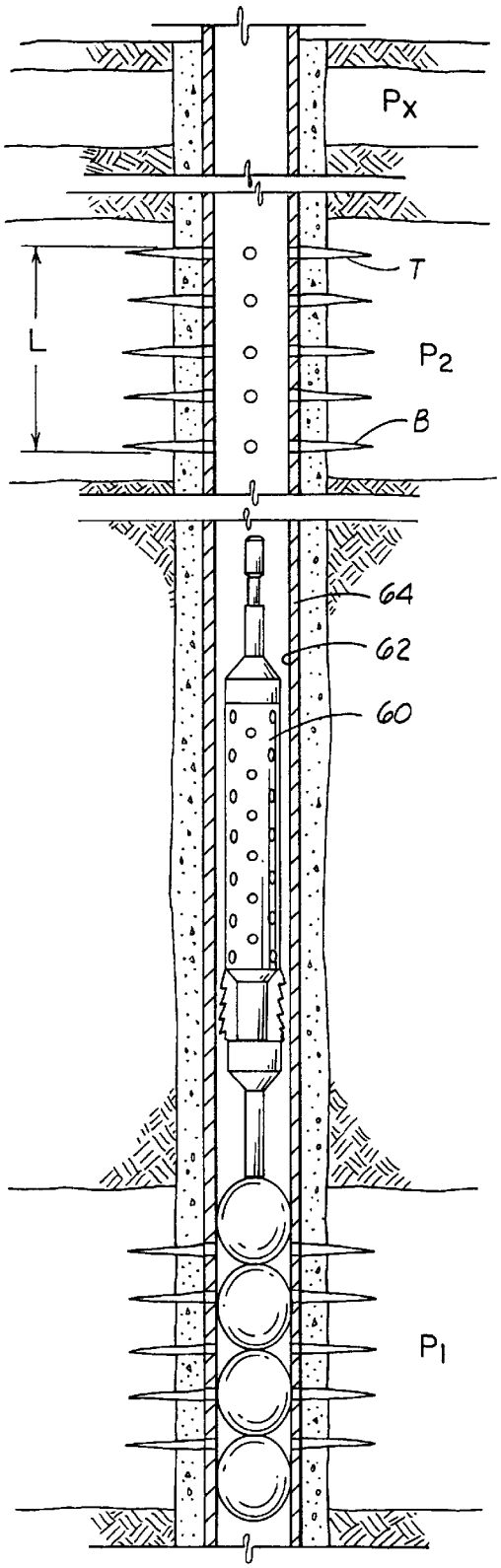
FIG. 7 schematically shows the embodiment of FIG. 6 after the perforating gun shown in FIG. 6 has been fired and has dropped downward in the wellbore.

Although FIGS. 1 and 2 depict a perforating gun lowered on a tubing, and, although it is desirable to retrieve the perforating guns, the guns may be lowered on a wireline, coiled tubing or may be attached to the casing before they are actuated. The guns may also be left in the wellbore in certain circumstances. For example, as depicted in FIGS. 4 and 5, a perforating gun 60, which may be actuated by casing pressure, may be hung adjacent a zone $P_1$ in a wellbore 62 having casing 64 installed therein. Casing 64 may have a diameter 22. FIG. 5 schematically depicts the wellbore after the perforating gun has been actuated to perforate casing 64 and communicate the zone $P_1$ with the wellbore 62 and has dropped to the bottom of the wellbore. FIG. 6 shows the wellbore 62 after zone $P_1$ has been fractured and isolated by pumping the sealing means 40 into the wellbore in the manner described herein to seal the casing adjacent the perforations communicating the zone $P_1$ with the wellbore, and shows a perforating gun 60 hung in the casing adjacent an additional zone, in this case zone $P_2$. The perforating, fracturing and sealing operations can then be repeated for zone $P_2$. As depicted in FIG. 7, after zone $P_2$ has been perforated, the gun may drop downward in the wellbore and will rest on top of the sealing means which seal the zone $P_1$ therebelow. The gun can be retrieved or can be left in the hole if there is enough formation pressure to backflow the balls and the gun out of the wellbore.

Figure 8:
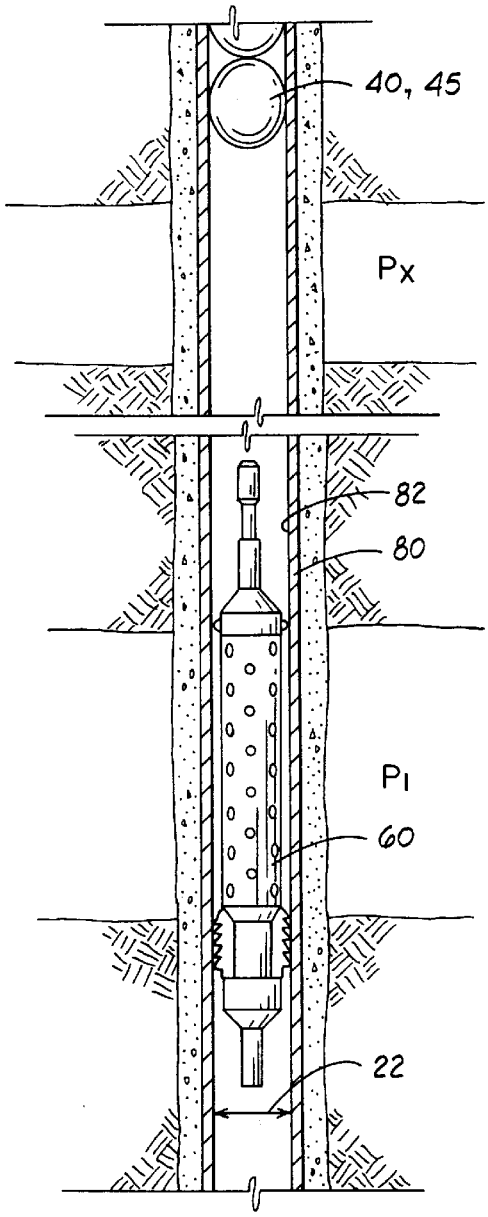
FIG. 8 schematically shows a perforating gun hung in the casing adjacent a formation to be perforated, and shows the sealing means in the casing above the perforating gun.
Figure 9:
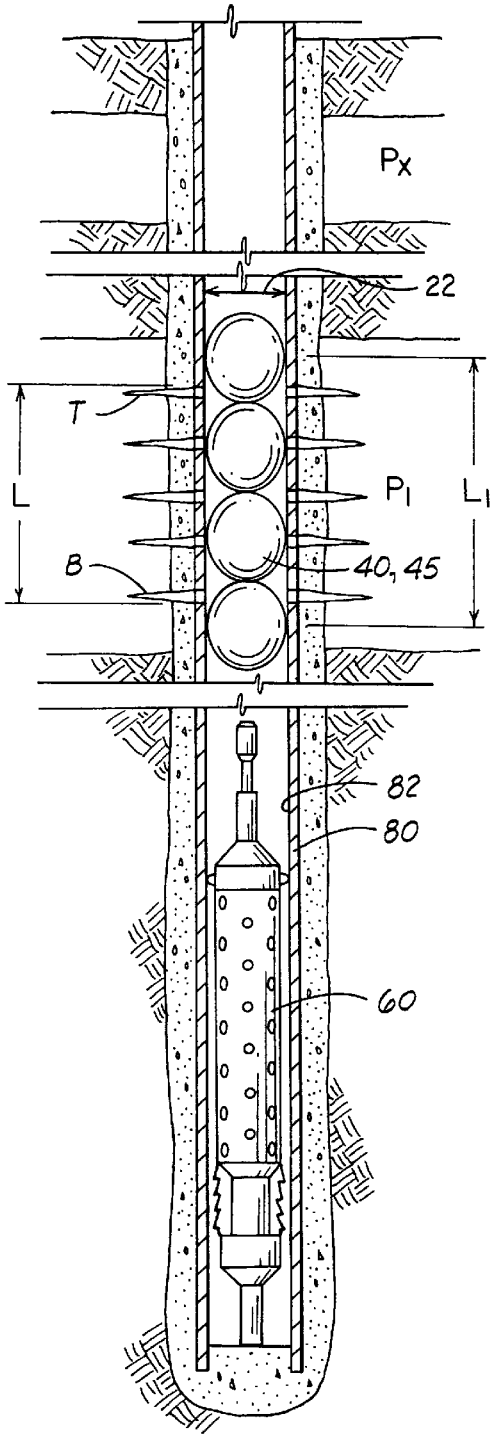
FIG. 9 schematically shows the wellbore of FIG. 8 after the formation has been perforated and sealed.

In an additional embodiment shown in FIGS. 8 and 9, pressure-actuated perforating guns can be hung in a casing 80 installed in a wellbore 82 adjacent a zone P depicted in FIG. 8 as zone $P_1$. Sealing balls 45 can be positioned above perforating guns in the casing prior to actuating the gun. Casing 80 has a diameter 22. A predetermined amount of fracturing fluid may be in the casing between the balls 45 and the gun 60. Pressure above the balls can be increased so that hydraulic pressure in the casing is increased as necessary to actuate the perforating gun. Once the perforating gun is actuated to perforate the casing, the gun will drop to the bottom of the hole and the fracturing fluids will be displaced through the perforations into the zone $P_1$ and the balls will seal against the casing to prevent communication therethrough after the fracturing fluid has been displaced into the zone in the manner described herein. This procedure can be repeated for any number of zones intersected by the wellbore. The gun utilized to make perforations in the lowermost zone obviously cannot be backflowed and cannot be retrieved until after the sealing means is removed. Guns used to perforate zones thereabove will fall and will rest on the balls used to isolate the zone immediately therebelow. Such guns can be retrieved mechanically after the balls used to seal zones thereabove have been removed, or if sufficient formation pressure exists, can be backflowed out of the well. Thus, the present invention is well adapted to carry out the objects and advantages mentioned as well as those that are inherent therein. While numerous changes may be made by those skilled in the art, such changes are encompassed within the spirit of this invention as defined by the appended claims.

What is claimed is:

1. A method for isolating production zones in a wellbore having casing installed therein comprising:

perforating said casing adjacent a first said production zone to communicate said first said production zone with said wellbore; and pumping a first sealing means into said wellbore until said sealing means is adjacent said first production zone, to seal said wellbore at said first production zone, so that said first said production zone is isolated and communication between said wellbore and said production zone is prevented; and wherein said first sealing means comprises at least one deformable ball having an undeformed diameter that is larger than an inner diameter of said casing.

2. The method of claim 1 further comprising:

perforating said casing adjacent a second said production zone intersected by said wellbore to communicate said second said production zone with said wellbore, said second production zone being above said first said production zone.

3. The method of claim 2 further comprising:

removing said first sealing means from said wellbore; and allowing fluid from said first and said second said production zones to be communicated into said wellbore.

4. The method of claim 2 further comprising:

pumping a second sealing means into said wellbore adjacent said second said production zone, to seal said wellbore at said production zone, so that said second said production zone is isolated and communication between said second said production zone and said wellbore is prevented by said second sealing means wherein said second sealing means comprises at least one deformable ball having an undeformed diameter that is larger than an inner diameter of said casing.

5. The method of claim 4 further comprising:

perforating said casing adjacent a desired number of additional said production zones above said second said production zone to establish communication between said additional said production zones and said wellbore, said additional said production zones being located above said second said production zone;

pumping additional sealing means into said wellbore to seal said wellbore adjacent all of said desired number of said additional said production zones, wherein said casing is perforated and sealed at each of said additional said production zones in sequence from a lowermost additional zone to said uppermost additional zone, and wherein said pumping step is not performed on said uppermost zone so that said uppermost zone remains unsealed, each of said additional said zones being perforated and sealed prior to another of said additional said zones thereabove being perforated; and wherein said additional sealing means comprises at least one deformable ball having an undeformed diameter that is larger than an inner diameter of said casing.

6. The method of claim 5 further comprising hydraulically fracturing selected of said first, said second and said additional said production zones prior to pumping corresponding sealing means into said wellbore to seal said selected production zones.

7. The method of claim 5 wherein each of said sealing means comprises a plurality of deformable balls having an undeformed diameter that is larger than an inner diameter of said casing.

8. The method of claim 5 further comprising removing said first, second and said additional sealing means from said wellbore and allowing fluid from said first, second and additional production zones to be communicated into said wellbore.

9. The method of claim 8 wherein said removing step comprises drilling through said sealing means so that each of said production zones are communicated with said wellbore.

10. The method of claim 2 further comprising displacing a fracturing fluid through said wellbore and into said first production zone prior to pumping said first sealing means downward in said wellbore to said first production zone.

11. The method of claim 2 wherein said sealing means comprises a plurality of elastically deformable balls, said balls having an undeformed diameter that is larger than an inner diameter of said casing.

12. The method of claim 11 wherein said elastically deformable balls are comprised of nitrile rubber.

13. A method of isolating hydrocarbon containing formations intersected by a wellbore drilled for the production of hydrocarbons therethrough, said wellbore having a casing installed therein, said method comprising:

(a) perforating said casing adjacent a first of said formations to make perforations in said casing adjacent said first said formation and provide communication between said first said formation and said wellbore;

(b) placing a sealing means in said casing to seal against the side of said casing; and (c) displacing said sealing means downwardly in said casing until said sealing means is adjacent said perforations, thereby sealing said casing adjacent said first said formation to prevent communication between said wellbore and said first said formations, wherein said sealing means comprises at least one deformable ball having an undeformed diameter that is larger than an inner diameter of said casing; and repeating steps (a), (b) and (c) for at least one other of said hydrocarbon-containing formations, in sequence from a lowermost of said other of said formations to an uppermost of said other of said formations until said casing has been perforated and sealed adjacent a desired number of formations, wherein only step (a) is performed on said uppermost of said other of said formations.

14. The method of claim 13 further comprising performing steps (b) and (c) on said uppermost of said other of said formations.

15. The method of claim 13 further comprising fracturing selected of said first and said other of said formations, wherein said fracturing step is performed prior to said displacing step.

16. The method of claim 13 wherein said fracturing step comprises forcing a proppant containing fracturing fluid into said selected of said first and said other of said formation zones through said perforations in said casing adjacent said selected formations prior to sealing said casing adjacent said selected formations.

17. The method of claim 13 wherein each said sealing means comprises a plurality of elastically deformable balls.

18. The method of claim 17 wherein said elastically deformable balls are comprised of nitrile rubber.

19. The method of claim 17 wherein said deformable balls in each said sealing means are stacked so that said balls seal said casing above and below the perforations made in said casing adjacent the corresponding said first and said at least one other of said formations.

20. The method of claim 13 further comprising removing said sealing means adjacent said first and said at least one other of said formations and communicating said formations with said wellbore.

21. The method of claim 20 wherein said removing step comprises drilling through said sealing means.

22. A method of fracturing and isolating production zones intersected by a wellbore having casing installed therein, comprising:

(a) lowering a pressure-actuated perforating gun into said wellbore;

(b) hanging said perforating gun in said casing adjacent one of said production zones;

(c) filling said casing with a predetermined amount of fracturing fluid;

(d) positioning a sealing means in said casing above said predetermined amount of fracturing fluid;

(e) actuating said perforating gun to perforate said casing adjacent said one of said production zones, wherein said perforating gun automatically releases from said casing after said actuating step, and falls downward in said wellbore;

(f) fracturing said one of said zones with said predetermined amount of fracturing fluid; and (g) sealing said casing adjacent said one of said zones with said sealing means to isolate said one of said zones and prevent communication therefrom into said wellbore.

23. The method of claim 22 wherein said actuating step comprises applying hydraulic pressure in said wellbore.

24. The method of claim 22 further comprising:

(h) after step (g), lowering a perforating gun into said wellbore and positioning said perforating gun adjacent another of said production zones;

(i) perforating said another of said production zones;

(j) removing said sealing means from said wellbore; and (k) allowing fluid from said one of said production zones and said another of said production zones to communicate with said wellbore.

25. The method of claim 22 further comprising repeating steps (a)–(g) for any number of zones from which production is desired intersected by said wellbore except wherein step (g) is not performed on an uppermost of said desired zones.

26. The method of claim 25 wherein said fracturing and said sealing steps comprises applying hydraulic pressure in said wellbore above said sealing means after said perforating gun is actuated, to force said fracturing fluid into said one of said production zones and said desired number of zones through the perforations in the casing adjacent each of said zones.

27. The method of claim 25 wherein step (g) is performed on said uppermost of said desired zones.

28. The method of claim 22 wherein said fracturing and said sealing steps comprises applying hydraulic pressure in said wellbore above said sealing means after said perforating gun is actuated, to force said fracturing fluid into said one of said production zones through the perforations in the casing adjacent said one of said production zones.

29. The method of claim 22, wherein said sealing means comprises a plurality of deformable balls, said deformable balls having an undeformed cross-sectional diameter greater than the diameter of the casing in the wellbore.

* * * * *